United States Patent [19]

Verbeek et al.

[11] Patent Number: 4,929,863

[45] Date of Patent: May 29, 1990

[54] HIGH-PRESSURE GAS DISCHARGE LAMP AND LUMINAIRE PROVIDED WITH SAID LAMP

[75] Inventors: Willibrordus G. C. Verbeek, Turnhout; Hendrik Wijbenga; Marie-Madelene Vossen-Bergmans, both of Eindhoven, all of Netherlands

[73] Assignee: U.S. Philips Corporation, New York, N.Y.

[21] Appl. No.: 237,341

[22] Filed: Aug. 26, 1988

[30] Foreign Application Priority Data

Sep. 4, 1987 [NL] Netherlands ..... 8702086

[51] Int. Cl.[5] ..... H01J 61/073; H01J 61/20

[52] U.S. Cl. ..... 313/113; 313/117; 313/620; 313/638; 362/296; 362/350

[58] Field of Search ..... 313/620, 631, 634, 113, 313/117, 638; 362/296, 341, 347, 350

[56] References Cited

U.S. PATENT DOCUMENTS

| | | | |
|---|---|---|---|
| 4,161,672 | 7/1979 | Cap et al. | 313/620 |
| 4,171,498 | 10/1979 | Fromm et al. | 313/641 |
| 4,293,901 | 10/1981 | Hernandez | 362/346 |
| 4,345,178 | 8/1982 | Pappas et al. | 313/113 |

FOREIGN PATENT DOCUMENTS

| | | |
|---|---|---|
| 832638 | 9/1938 | France . |
| 6711944 | 3/1969 | Netherlands . |
| 1061958 | 3/1967 | United Kingdom . |
| 1097626 | 1/1968 | United Kingdom . |

*Primary Examiner*—Kenneth Wieder

*Attorney, Agent, or Firm*—Brian J. Wieghaus

[57] ABSTRACT

The high-pressure gas discharge lamp has an ovoidal discharge space with oppositely arranged rod electrodes having a electrode coils spaced from the tip ends of the electrode. The ratio between the electrode distance d and the largest diameter of the discharge space D lies between 0.75 and 1.25. The lamp has a comparatively high power of 1600–2000 W and a defined Br/I ratio of 1.5–4. When arranged transversely in a luminaire having a concave rotation-symmetrical reflector and a screen, the lamp produces an accurately defined light beam suitable for illumination of sports grounds.

16 Claims, 2 Drawing Sheets

HIGH-PRESSURE GAS DISCHARGE LAMP AND LUMINAIRE PROVIDED WITH SAID LAMP

BACKGROUND OF THE INVENTION

The invention relates to a high-pressure gas discharge lamp comprising

- a quartz glass lamp vessel which is saled in a vacuum-tight manner, encloses a discharge space having a major axis and has an ionizable filling containing mercury, rare gas and rare earth halide,
- rod-shaped electrodes arranged opposite to each other along the major axis of the discharge space and having respective tips, the tips having a relative distance d,
- current supply conductors passed to the exterior through the wall of the lamp vessel opposite to each other and connected to a respective electrode,
- the distance d between the tips of the electrodes having a given ratio d/D to the largest diameter D of the discharge space transverse to its major axis,
- which lamp consumes during operation a power of at least 250 W.

The invention further relates to a luminaire provided with such a lamp. Such a lamp is known from GB Patent Specification 1,378,188.

The known lamp is intended inter alia to be used for the illumination of vast sports grounds. The lamp has an elongate tubular lamp vessel of quartz glass, in the proximity of whose ends heat-resistant electrodes are arranged. The distance d between electrodes is larger than and preferably a multiple of the diameter D of the discharge space. In a lamp of 3.5 kW, d is 155 mm and D is 31 mm so that d/D=5. In a lamp of 250W, d is 25 mm and D is 14 mm so that d/D still has the comparatively high value of 1.8. The consumed power per mm distance between the electrodes is very low, i.e. 23 and 10 W/mm, respectively.

In this known lamp, a low power already leads to a considerable electrode gap, while a high power leads to a very large electrode gap and hence to a considerable and a very large discharge arc, respectively. With increasing size of the discharge arc, the size of a luminaire required to concentrate the generated light strongly increases. The quality of the light beam deteriorates.

A disadvantage of sports ground illumination equipments is that they produce a large quantity of scattered light, as a result of which the environment is also illuminated over a large width in a disturbing manner. Besides this disturbing scattered light and the low efficiency associated therewith, the known lamp with a very voluminous discharge arc in respect of the consumed power has the disadvantage that the luminaire, which is consequently necessarily large, requires due to wind-sail and weight a heavy post and hence a heavy foundation. The discharge arc is then voluminous not only because it is long, but also because in horizontal operation (in operation with a straight line through the electrodes in a horizontal plane) it will bulge in upward direction.

Other disadvantages of the known lamp are a strong decrease of the light output due to the phenomenon that the lamp vessel becomes less transparent due to blackening and attack of the quartz, and a comparatively short life of a few hundreds of hours as a result of electrodes breaking off.

SUMMARY OF THE INVENTION

The invention has for its object to provide a lamp of the kind described in the opening paragraph, which is suitable for sports ground illumination, whose generated light can readily be concentrated, which has a comparatively long life and in which the phenomenon of the lamp vessel becoming less transparent is counteracted.

According to the invention, this object is achieved in a lamp of the kind described in the opening paragraph in that

- the discharge space is ovoidal and the distance d between the tips of electrodes lies between 15 and 30 mm,
- the electrodes each have near their tips a wrapping of heat-resistant metal wire, which wrapping has a first layer of turns and a second layer of turns around the first layer and leaves free the tip of the electrode,
- the ratio d/D lies between 0.75 and 1.25,
- the numerical ratio between bromine atoms and iodine atoms in the gas filling Br/I lies between 1.5 and 4,
- the lamp consumes during operation at nominal voltage a power lying between 1600 and 2000W.

Due to the whole of coherent features, the lamp according to the invention is particularly suitable to be used for the illumination of large areas, such as sports grounds. The light generated by the lamp can very readily be concentrated by a comparatively small luminaire because the discharge arc generated by the lamp is compact. The lamp has a comparatively long life of at least 1500 hours due to a comparatively low maximum wall temperature of about 1000° C.

The compactness of the discharge arc having the described high power is determined in part by the values of d. At higher values of d, the size of the luminaire required strongly increases. At lower values of d, the load of the lamp vessel locally becomes too high to sufficiently avoid attack of the quartz glass. Attack of the quartz glass would lead to loss of light due to the fact that then the glass becomes less transparent. Further, the glass would obtain a light scattering effect, as a result of which the effectiveness of a luminaire for concentrating the light of the lamp would decrease.

The ratio d/D is of importance because at higher values than the specified values a strong attack of the quartz glass occurs, while at lower values the discharge arc has a strongly curved form, which reduces the concentrability of the generated light.

Also the ovoidality of the discharge space is of importance to avoid too curved a discharge arc. The shape is also of importance for the life of the lamp, as contact between the electrodes and the halide filling in the inactive conditions of the lamp and hence attack of these electrodes by the halide filling is counteracted thereby.

The electrodes have a defined point of termination for the discharge arc due to the non-wrapped electrode tips, while on the other hand the wrapping prevents too high a temperature of the electrodes, which would lead to a short life.

Also the specified Br/I ratio is of importance for the life. At values higher than 4, attack of the electrodes can occur, while at lower values than 1.5, blackening of the lamp vessel and hence shortening of the useful life of the lamp can occur.

The invention further relates to a luminaire provided with the high-pressure discharge lamp according to the invention, which is characterized by a concave rotation-symmetrical reflector having an optical axis, an apex at which the optical axis intersects the reflector and an optical centre on the optical axis, which reflector has openings adapted to receive the ends of the lamp vessel of the high-pressure discharge lamp, the high-pressure discharge lamp transverse to the optical axis of the reflector with the optical centre between the tips of its electrodes, a screen in the space surrounded by the reflector, which screen is mainly parallel to the electrodes of the lamp and is located at a distance from the optical axis of the reflector at the side of the lamp remote from the apex of the reflector.

The lamp and the luminaire together yield an accurately defined light beam. Due to the rotation-symmetrical form of the reflector, for example the form of a paraboloid, the beam is narrow also in planes through the electrodes of the lamp.

The screen in the reflector intercepts light which in the absence of said screen would leave the luminaire, for example in upward directions, without reflection by the reflector. With the use of the luminaire with the screen above the optical axis, the luminaire can be prevented from emitting light in horizontal or upwards directions if the luminaire is downwardly directed. Such light is in fact experienced as being very disturbing (scattered light).

The screen may be reflective at its side facing the axis. This results in that a considerable increase of the illumination efficiency of the luminaire is obtained. The side remote from the axis may be light-absorbing and may, for example, be frosted in black in order to prevent reflections on this surface.

In a favourable embodiment, the reflector is facetted. As a result, a larger homogeneity of the luminous intensity of the beam is obtained. The facets may be positioned, for example, in axial paths and also in circumferential paths on the reflector surface. With the use of a smooth reflector, for example in the form of a paraboloid, the lamp and the luminaire are particularly suitable to irradiate towers or very high buildings of, for example, a height of 100 m or more.

BRIEF DESCRIPTION OF THE DRAWINGS

An embodiment of the high-pressure discharge lamp and of the luminaire with this lamp according to the invention is shown in the drawings. In the drawings.

DESCRIPTION OF THE PREFERRED EMBODIMENT

Figure 1:
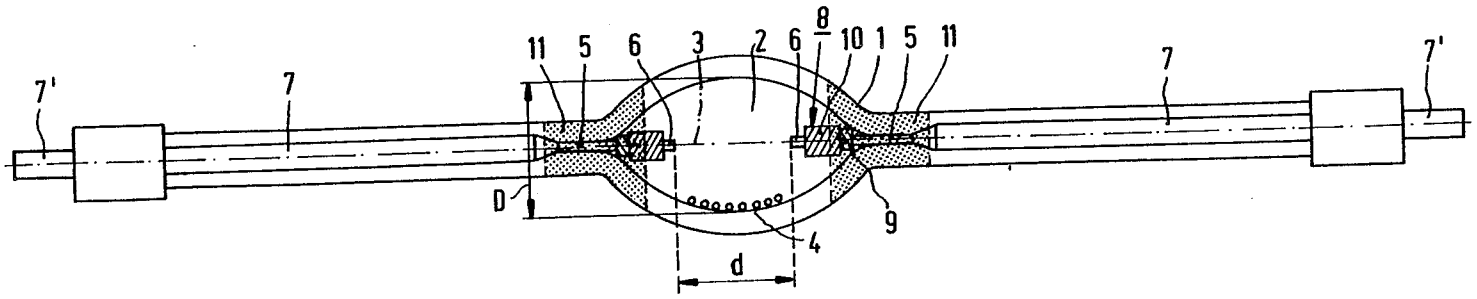
FIG. 1 is a side elevation of the lamp.

In FIG. 1, the high-pressure discharge lamp has a quartz glass lamp vessel 1 which is sealed in a vacuum-tight manner and encloses a discharge space 2 having a major axis 3. The discharge space 2 has an ionizable filling containing mercury, rare earth halide 4 and rare gas. Rod-shaped electrodes 5 are arranged opposite to each other along the major axis 3 of the discharge space 2 and these electrodes have respective tips 6. The tips 6 have a relative distance d. The current supply conductors 7, 7' are connected to a respective electrode 5 and are passed opposite to each other through the wall of the lamp vessel 1 to the exterior. The parts 7 of these current supply conductors 7, 7' are in the form of foils.

The discharge space 2 has a largest diameter D transverse to its major axis 3. There is a ratio between d and D. The lamp consumes during operation a power of at least 250W.

In the lamp according to the invention shown in FIG. 1, the discharge space 2 is ovoidal and the distance d between the tips 6 of the electrodes 5 lies between 15 and 30 mm. The electrodes 5 have near their tips 6 a wrapping 8 of heat-resistant metal wire, consisting, for example, like the electrodes 5, of tungsten. The wrappings 8 have a first layer of, for example, seven to ten turns 9 and a second layer of, for example, five to eight turns 10 around the first layer and leave free the tips 6 of the electrodes 5, for example over a length of 1 to 4 mm.

The ration d/D lies between 0.75 and 1.25. The lamp vessel 1 has near the electrodes 5 a coating 11 of $ZrO_2$. The numerical ratio of the bromine atoms and the iodine atoms in the gas filling Br/I lies between 1.5 and 4. The lamp consumes during operation a power between 1600 and 2000W.

The lamp can be filled per 1 mm distance between the electrode tips 6 with:

2–10 mbar of rare gas for example argon,

2–5 mg of mercury, 0.25–1 mg of rare earth halide, for example dysprosium halide, for example dysprosium bromide or a mixture of two or more rare earth halides, for example the bromides and/or iodides of dysprosium and holmium and/or thulium.

The filling can further contain caesium halide, for example 0.25–1 mg of caesium iodide per 1 mm distance between the electrode tips. This results in an arc diffusely terminating on the electrodes.

If desired, the filling may further contain 0.25–0.75 mg of $HgBr_2$ per 1 mm distance between the electrode tips and/or, as the case may be, 0.05–0.3 mg of $HgJ_2$. The numerical ratio between bromine atoms and iodine atoms in the filling then lies between 1.5 and 4.

In a test series of 25 lamps, the distance between the electrode tips d=25 mm and the ratio d/D=0.86. The diameter of the tungsten electrode rods was chosen to lie between 1500 and 2000 μm and amounted to 1750 μm. At a distance of 2 mm from their tips, the electrode rods were wrapped with tungsten wire of 800 to 1000 μm, in this case 900 μm, with nine turns in the first layer and seven turns in the second layer.

The filling of the lamp consisted of 150 mbar of Ar, 95 mg of Hg, 3.6 mg of $DyBr_3$, 3.6 mg of $HoBr_3$, 4.8 mg of $TmBr_3$, 11.75 mg of CsI, 10.50 mg of $HgBr_2$ and 3.0 mg of $HgI_2$.

The ratio Br/I then was 3.0. The lamps consumed at nominal voltage a power of 1800W and had a life of more than 1500 hr, that is to say that twenty-three of the lamps (i.e. at least 90% of the number) had after 1500 operating hours a light output of more than 85% of the light output after 100 operating hours.

Figure 2:
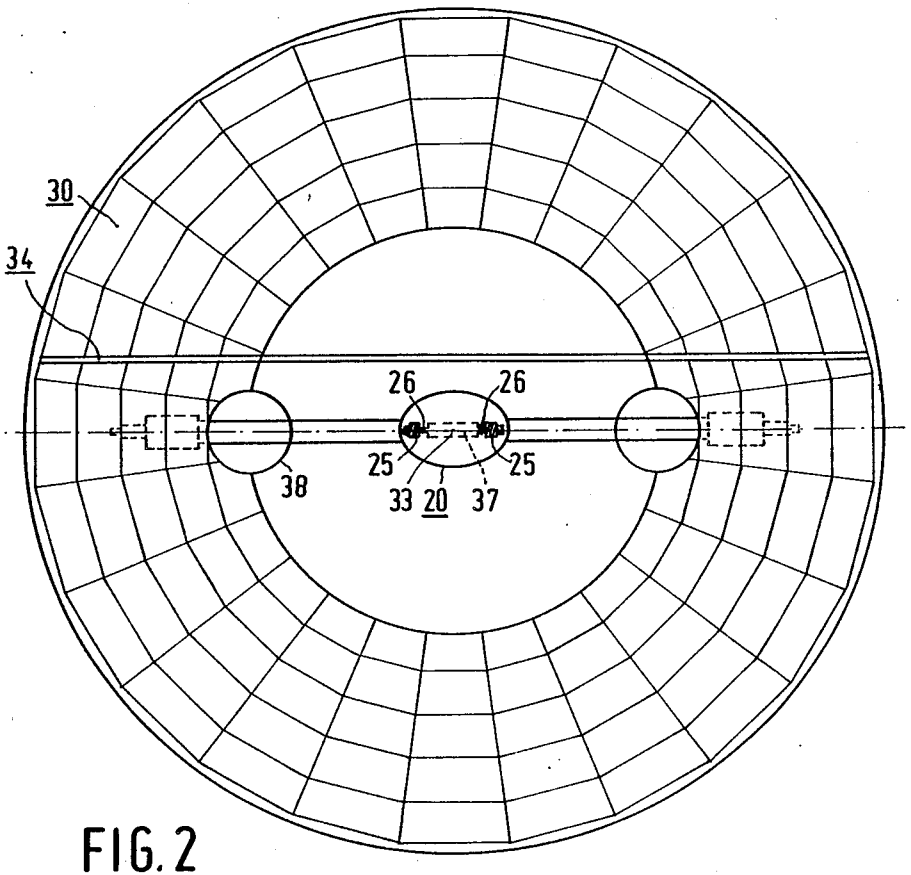
FIG. 2 is a front elevation of the luminaire, the lamp of FIG. 1 being diagrammatically shown in side elevation.
Figure 3:
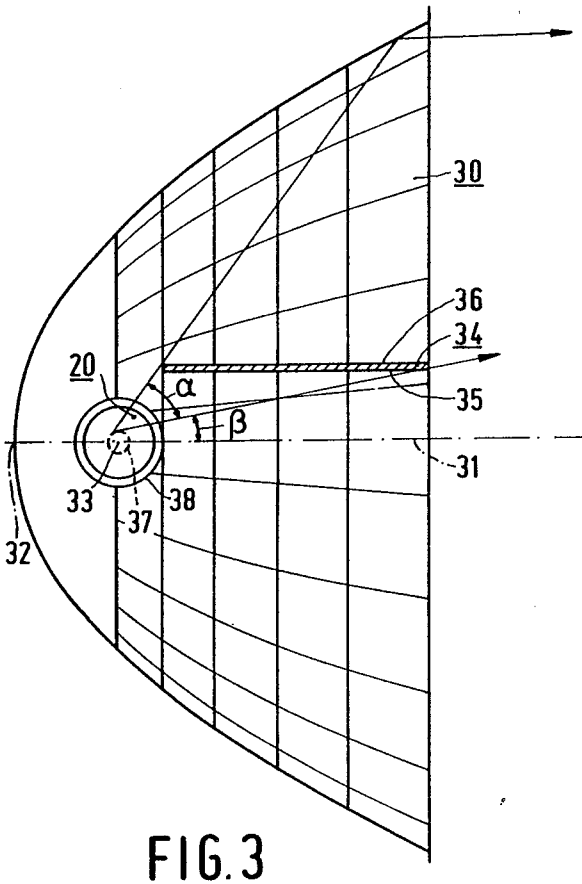
FIG. 3 is an axial sectional view of the reflector of FIG. 2.

FIGS. 2 and 3 show a luminaire provided with the high-pressure discharge lamp 20 according to the invention, which is shown only diagrammatically. The luminaire has a concave rotation-symmetrical reflector 30 having an optical axis 31 and an apex 32 at which the optical axis intersects the reflector 30. An optical centre 33 lies on the optical axis 31. The reflector 30 has openings 38 for receiving the ends of the lamp vessel of the high-pressure discharge lamp 20.

The high-pressure discharge lamp 20 is at right angles to the optical axis 31 of the reflector 30, the optical centre 33 lying between the tips 26 of the electrodes 25.

A screen 34 is present in the space surrounded by the reflector 30. The screen 34 is mainly parallel to the electrodes 25 of the lamp 20 and in the drawing also to the optical axis 31. The screen 34 is located at a distance from the optical axis 31 of the reflector 30 on the side of the lamp 20 remote from the apex 32 of the reflector 30. In the Figures, the reflector 30 is facetted and the screen 34 has a reflective surface 35 and a light-absorbing surface 36. The light-emitting part of the lamp 20 is indicated diagrammatically by 37.

The light emitted within the angle $\alpha$ is added by the screen 34 to the beam formed by the reflector 30. As a result, the luminaire substantially does not emit light in upward directions if the reflector 30 is directed downwards and the optical axis encloses at least an angle $\beta$ with the horizontal.

The luminaire shown is particularly suitable to be used to illuminate a sports ground from a height of 40 to 60 m.

What is claimed is:

1. A high pressure gas discharge lamp, comprising:

a lamp vessel enclosing an ovoidal discharge space defining a major axis of said lamp, said discharge space having a largest diameter D transverse to the major axis;

a pair of opposing electrodes disposed in said discharge space, each electrode comprising an electrode rod extending from said lamp vessel along the major axis and terminating at a tip end and an electrode coil on said electrode rod spaced from said tip end, said tip ends of said electrode rods being spaced a distance d between 15 and 30 mm and said discharge space having largest diameter D chosen such that $0.75 \leqq d/D \leqq 1.25$;

said discharge space having an ionizable filling comprising mercury, a rare gas, and bromine and iodine rare earth halides, the ratio between bromine and iodine atoms being between 1.5 and 4;

a pair of current-supply conductors, each connected to a respective electrode rod and extending through the lamp vessel to the exterior in a gas-tight manner; and said lamp consuming during normal lamp operation a power between 1600 and 2000 Watts.

2. A lamp as claimed in claim 1, wherein said electrode coil has two layers.

3. A lamp as claimed in claim 1, wherein said ionizable filling further comprises 0.25–1.0 mg of dysprosium halide per 1 mm of distance (d) between the electrode tips.

4. A lamp as claimed in claim 1, wherein said ionizable filling further comprises 0.25–1.0 mg of caesium halide per 1 mm of distance (d) between the electrode tips.

5. A lamp as claimed in claim 4, wherein said ionizable filling further comprises of 0.25–0.75 mg HgBr2 per 1 mm of distance (d) between the electrode tips.

6. A lamp as claimed in claim 4, wherein said ionizable filling further comprises of 0.05–0.3 mg $HgJ_2$ per 1 mm of distance (d) between the electrode tips.

7. A luminaire, comprising:

a concave rotationally symmetric reflector defining an optical axis, said reflector having an apex intersected by said optical axis and extending axially from said apex to a circumferential edge of said reflector, said circumferential edge being transverse to said optical axis and defining a window of said reflector, said reflector having a focus on said optical axis between said apex and said circumferential edge;

a high pressure gas discharge lamp, said discharge lamp comprising a lamp vessel enclosing an ovoidal discharge space defining a major axis, said vessel having a pair of elongate seals extending from opposite ends of said ovoidal discharge space along said major axis for sealing said lamp vessel in a gas-tight manner;

a pair of opposing electrodes in said discharge space, each electrode comprising an electrode rod extending from a respective seal along the major axis and terminating at a tip end and an electrode coil on said electrode rod spaced from said tip end;

a pair of current-supply conductors, each connected to a respective electrode rod and extending through a respective elongate seal to the exterior, said discharge space containing an ionizable filling comprising mercury, a rare gas, and rare earth halides, and means for securing said discharge lamp with the focus of said reflector between said electrode tip ends, said means comprising said reflector having a pair of opposing openings through which said elongate seals extend; and a light-intercepting screen arranged within said reflector, and spaced from said optical axis.

8. A luminaire as claimed in claim 7, wherein said tip ends of said electrodes are spaced a distance d between 15 and 30 mm.

9. A luminaire as claimed in claim 8, wherein said rare earth halides consist of bromine and iodine halides and the ratio of bromine to iodine is between 1.5 and 4.

10. A luminaire as claimed in claim 9, wherein said discharge space has a widest dimension D transverse to the major axis chosen such that $0.75 \leqq d/D \leqq 1.25$.

11. A luminaire as claimed in claim 10, wherein said lamp consumes a power during normal lamp operation between 1600 and 2000 Watts.

12. A luminaire as claimed in claim 8, wherein said discharge space has a widest dimension D transverse to the major axis chosen such that $0.75 \leqq d/D \leqq 1.25$.

13. A luminaire as claimed in claim 7, wherein said lamp consumes a power during normal lamp operation between 1600 and 2000 Watts.

14. A luminaire as claimed in claim 7, wherein said tip ends of said electrodes are spaced a distance d between 15 and 30 mm.

15. A reflector, comprising:

a rotationally symmetric reflecting surface defining an optical axis and having a focus on said optical axis, said reflecting surface extending in the axial direction from an apex of said reflector intercepted by said optical axis to a circumferential edge of said reflector, said circumferential edge defining a window of said reflector transverse to said optical axis, said reflecting surface having a parabolic cross section in planes through and parallel to said optical axis; and a light-intercepting planar screen disposed in said reflector, said screen being spaced from and parallel to said optical axis and extending between opposing reflecting surfaces, said screen having a reflective surface facing towards said optical axis and a light absorbing surface facing away from said optical axis, said screen having an edge spaced between said focus and said circumferential edge such that said screen prevents light emanating from a light source arranged at said focus from exiting said reflector on one side of said optical axis without being reflected by the reflecting surface.

16. A reflector as claimed in claim 15, wherein said reflecting surface is faceted.

* * * * *